US005350071A

United States Patent [19]

Pond

[11] Patent Number: 5,350,071

[45] Date of Patent: Sep. 27, 1994

[54] SUSPENDABLE TRAY

[76] Inventor: Kelan B. Pond, 3230 Kenicott Dr., Walled Lake, Mich. 48390

[21] Appl. No.: 20,105

[22] Filed: Feb. 19, 1993

[51] Int. Cl.[5] ..... A47F 5/00

[52] U.S. Cl. ..... 211/70.6; 211/117; 248/318

[58] Field of Search ..... 211/70.6, 113, 117, 211/118, 86; 248/317, 318, 328, 327

[56] References Cited

U.S. PATENT DOCUMENTS

| | | | |
|---|---|---|---|
| 2,402,141 | 6/1946 | Holman et al. | 211/113 X |
| 4,032,102 | 6/1977 | Wolf et al. | 248/318 |
| 4,232,917 | 11/1980 | Reinhardt | 211/117 X |
| 4,422,556 | 12/1983 | Moore | 211/117 X |
| 4,441,583 | 4/1984 | Vaught | 211/113 X |
| 4,874,100 | 10/1989 | Smaqula | 211/113 X |
| 4,911,083 | 3/1990 | Considine | 211/70.6 X |

FOREIGN PATENT DOCUMENTS

| | | | |
|---|---|---|---|
| 660839 | 4/1963 | Canada | 248/328 |

*Primary Examiner*—Robert W. Gibson, Jr.
*Attorney, Agent, or Firm*—Peter D. Keefe

[57] ABSTRACT

A suspendable tray for being suspended from an overhead structure, which is particularly intended for use by tradesmen, composed of a tray and a pair of adjustable length suspension members connected thereto. One end of each of the suspension members terminates in a holding member for holding the suspension members with respect to some overhead structure in a selectively releasable manner. Further according to the present invention, the tray may have compartments and other provisions for neat and ready placement of tools and supplies.

18 Claims, 2 Drawing Sheets

FIG. 1
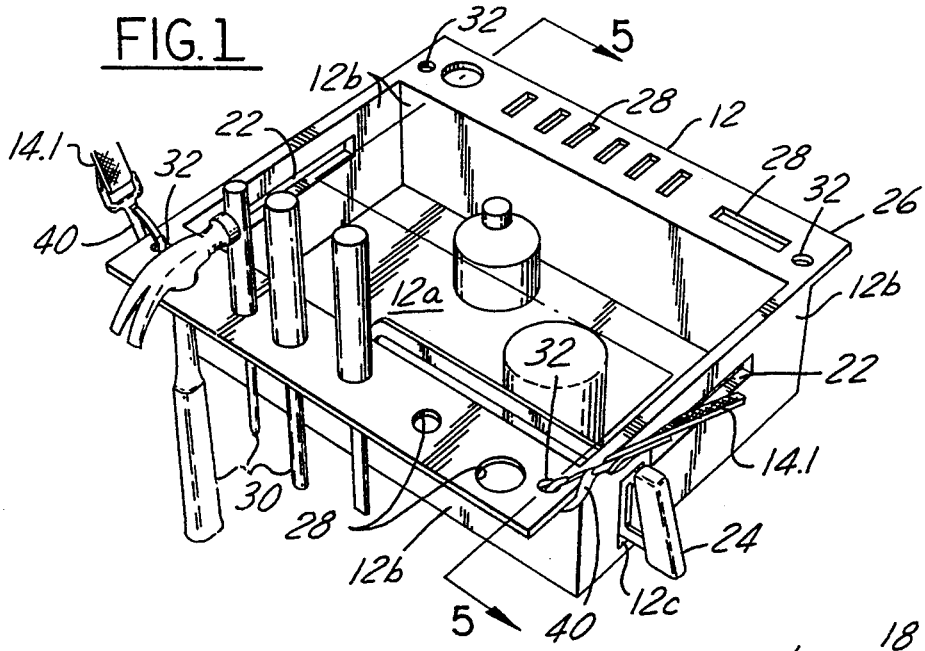
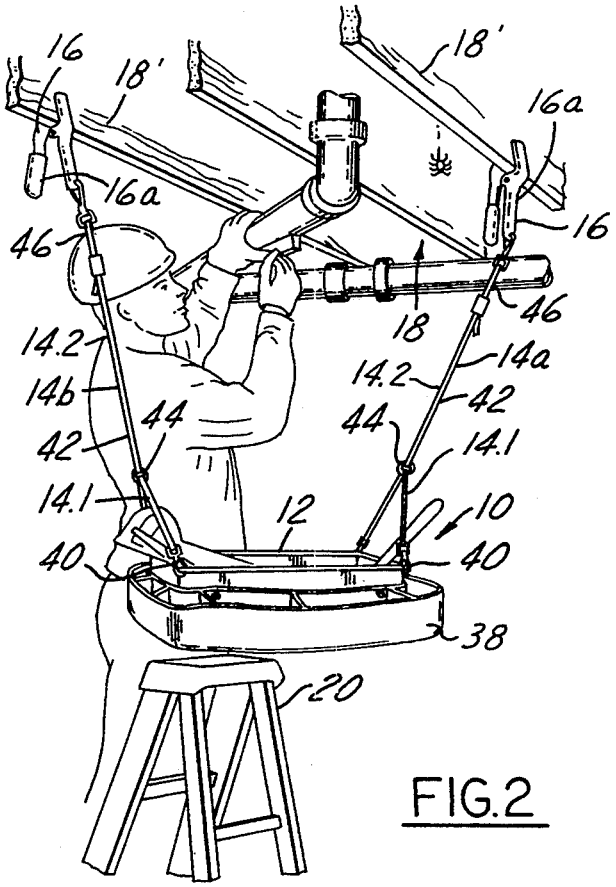
FIG. 2
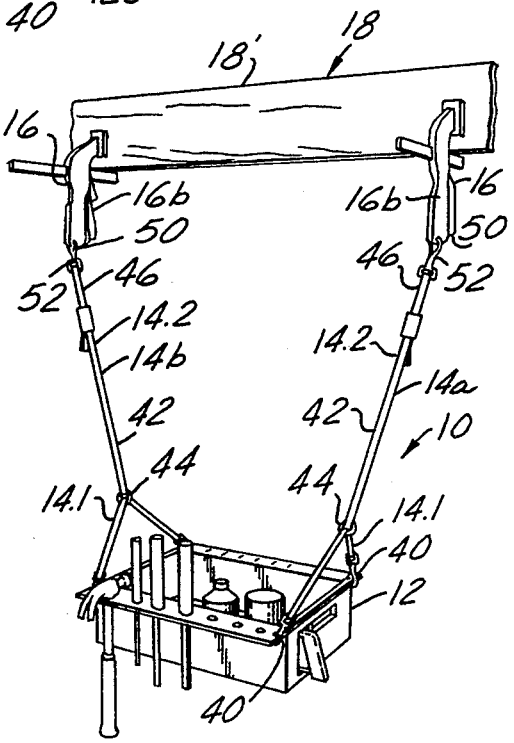
FIG. 3

SUSPENDABLE TRAY

BACKGROUND OF THE INVENTION

1. Field of the Invention

The present invention relates to tool holders used by tradesmen, and in particular to a tray of the aforesaid class having provision for being suspended at a selected height from a ceiling structure.

2. Description of the Prior Art

Tradesmen utilize tool holders, such as as tool boxes and the like, as a caddy for carrying and conveniently holding their tools and supplies.

Problematically, when a tradesman needs to work in an overhead work area, such as plumbing or electrical work, the tradesman who needs ready access to several different items from his tool holder will usually place his tool holder on his work ladder. This is because this location affords an easy reach to his tools and supplies the instant he needs them, thereby enhancing his efficiency on the job. However, this create an undue unbalance situation for the ladder, especially when the tradesman needs to reposition the ladder. Unless the tradesman removes the tool holder from the ladder before commencing to move the ladder, he risks the dangers associated with the tool holder falling thereoff during the repositioning.

Accordingly, what is needed is a tray which can be suspended at a selected location so that the tools and supplies therein are easy to reach by a tradesman who has overhead work to do.

SUMMARY OF THE INVENTION

The present invention is a suspendable tray composed of a tray and a pair of adjustable length suspension members connected thereto. One end of each of the suspension members terminates in a holding member for holding the suspension members with respect to some overhead structure in a selectively releasable manner. Further according to the present invention, the tray may have compartments and other provisions for neat and ready placement of tools and supplies.

Accordingly, it is an object of the present invention to provide a tray which is suspendable from an overhead structure and which has provision for selecting the height of suspension of the tray.

These, and additional objects, advantages, features and benefits of the present invention will become apparent from the following specification.

BRIEF DESCRIPTION OF THE DRAWINGS

FIG. 1 is a partly broken away perspective view of the suspendable tray according to the present invention, showing the tray and a part of the suspension members; tools and accessories are shown being used with the tray.

FIG. 2 is a perspective view of the suspendable tray, shown in a typical environment of use; the suspension members are shown with a first form of holding member, and the tray is shown with an optional pouch for holding tools and supplies.

FIG. 3 is a perspective view of the suspendable tray, shown in use and shown with a second form of holding member.

DETAILED DESCRIPTION OF THE PREFERRED EMBODIMENT

Figure 4:
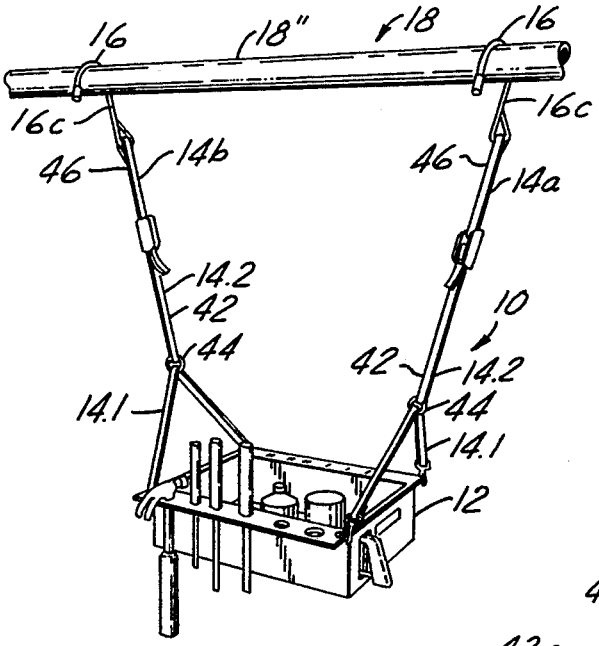
FIG. 4 is a perspective view of the suspendable tray, shown in use and shown with a third form of holding member.

Referring now to the Drawing, FIG. 2 shows the suspendable tray 10 according to the present invention depicted in a typical environment of operation. As can be seen, the suspendable tray 10 is composed of a tray 12, first and second suspension members 14*a* and 14*b* which connect at a first end thereof, respectively, to opposite ends of the tray, and a holding member 16 connected, respectively, to a second end of each of the first and second suspension members. The holding members 16 are structured to selectively engage with an overhead structure 18 so as to suspendably support the tray 12 via the first and second suspension members 14*a*, 14*b*. Each of the first and second suspension members 14*a*, 14*b* are selectively adjustable in length, thereby affording the tradesman the ability to suspend the tray 12 at a convenient height that is most suitable to his particular work endeavor. Accordingly, as can be understood by a review of FIG. 2, the tray 12 is effectively and conveniently located for efficient work by being safely suspended from the overhead structure 18, entirely free of the nearby ladder 20. The structure and function of the suspendable tray 10 will now be detailed with greater specificity with reference now being had additionally to the remaining Figures.

FIG. 1 shows the tray 12 in detail. In this regard, the tray 12 is composed of a floor 12*a* and a sidewall 12*b* which interconnects with the floor. Preferably, the sidewall 12*b* and the floor 12*a* together form a rectangular shape defined by four corners which provides an open box-like configuration. Of course, other shapes are possible for the tray 12. User handle slots 22 are preferably provided in the sidewall 12*b* at opposite ends of the tray 12. Preferably the floor 12*a* and the sidewall 12*b* are mutually sealably joined. Selected openings 12*c* may be provided in the floor 12*a* or the sidewall 12*b* so as to accommodate particular tools 24, supplies or other articles. It is preferred for a lip 26 to be provided around the upper periphery of the sidewall 12*b*. It is further preferred for the lip 26 to be provided with various sized and dimensioned apertures 28 for holding tools 30 or other articles. In order that the suspension members have connection locations with respect to the tray 12, the lip 26 is provided with four holes 32 that are mutually and symmetrically spaced apart for balance, preferably being located proximate to each of the four corners of the tray 12. Alternatively, the suspension members can be directly connected with the sidewall 12*b* via holes therein. Alternatively, an interconnection involving other than by holes is possible, such as by connection rings connected with either the lip 26 or the sidewall 12*b*.

Figure 8:
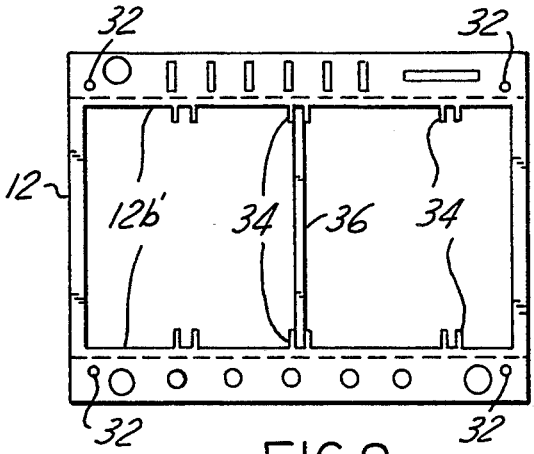
FIG. 8 is a top plan view of the tray according to the present invention, shown with a dividing wall feature.

As depicted in FIG. 8, the interior side 12*b*′ of the sidewall 12*b* may be provided with at least one pair of guide slots 34 for holding a dividing wall 36 therebetween. In this regard, the dividing wall 36 is vertically slid in and out of the guide slots 34 depending on the desirability of its presence for separating articles in the tray 12.

Figure 6:
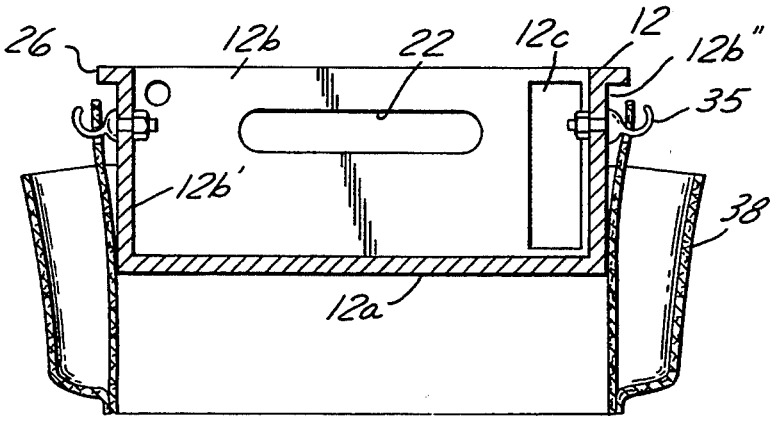
FIG. 6 is a side view of the tray according to the present invention, seen along arrow 6 in FIG. 2.

As depicted in FIGS. 2 and 6, the exterior side 12b'' of the sidewall 12b may be provided with an encircling pouch 38 for holding various articles, such as tools. The pouch 38 is connected to the sidewall 12b by any convenient fastening means, such as by hooks 35. The pouch 38 is preferred to be constructed of a flexible material, such as leather and be compartmentalized.

As can be discerned from FIGS. 2, 3 and 4, the first and second suspension members 14a, 14b are elongate and flexible. Suitable materials therefor are rope, chain or what is most preferable, woven strap. In the case of woven strap, the preferred material of construction is strong, durable and flexible, such as woven nylon or another woven synthetic fiber material. Each of the first and second suspension members 14a, 14b is preferably constructed of two parts, a tray connection portion 14.1 and an adjustable portion 14.2.

Each of the tray connection portions 14.1 has first and second ends which connect, respectively, with two holes 32 located on a respective end of the tray 12. Preferably, connection of the tray connection portion 14.1 to the tray 12 is provided by snaps 40, but utilization of another connection mechanism is permissible.

Figure 7:
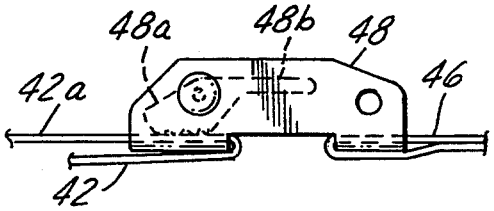
FIG. 7 is a side view of a one-way sliding clasp connected with a suspension member of the present invention.
Figure 5:
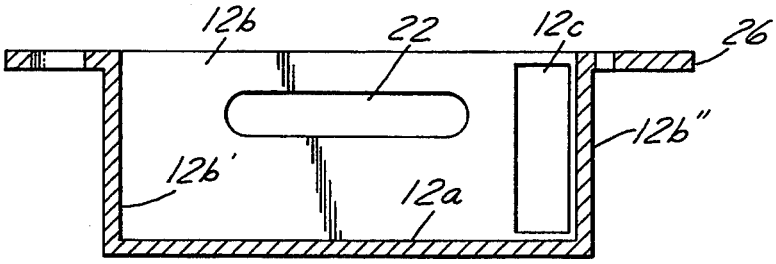
FIG. 5 is an end view of the tray according to the present invention, seen along lines 5—5 in FIG. 1.

Each adjustable portion 14.2 of the first and second suspension members 14a, 14b is provided with a first segment 42 which connects at one end to a respective tray connection portion 14.1, such as by a ring 44 a hook, a snap, or some other interconnection device. Further, each adjustable portion 14.2 is further provided with a second segment 46 that connects with a respective aforementioned holding member 16. In order that each adjustment portion 14.2 be adjustable in length between the holding member 16 and the respective tray connection portion 14.1, a one-way sliding clasp 48 is provided which has operational features like that of a conventional car seat belt buckle. As can be understood from FIG. 7, the first segment 42 loops up around the clasp 48 and terminates in a loose end 42a, and the second segment 46 is connected with the other end of the clasp. A user can pull on the loose end 42a to easily shorten the length of the adjustable portion 14.2, but the spring loaded gripper 48a prevents any elongation unless the user presses the release side of the gripper 48b.

Of course, the above described suspension member structure is by way of preferred example only, and it is within the purview of those skilled in the art to modify the structural specifics as outlined hereinabove. For instance, VELCRO could be used as length adjustment mechanism between the first and second segments 42, 46, or hooks slipping into a selected hole of a plurality of spaced holes along the suspension member 14a, 14b could alternatively be used. Also, it is not essential to have a separate tray portion 14.1 and an adjustable portion 14.2.

As indicated hereinabove, the first and second suspension members 14a, 14b are suspended from an overhead structure 18 which is of sound and strong construction. For instance, this may be water pipes, as shown in FIG. 4, or floor joists as shown in FIGS. 2 and 3. In order that the suspension members 14a, 14b be easily and safely secured to the overhead structure 18 and yet be selectively releasable therefrom, the holding member 16 may have one or more forms so as to be specifically suitable for connecting therebetween. For instance, FIG. 2 depicts a first form of holding member 16 in the form of a spring loaded clamp 16a, shown clampably engaged with respect to floor joists 18'. The spring clamp 16a is provided with a connection hole 50 into which inserts a hook or snap 52 connected with respective suspension members 14a, 14b. In FIG. 3, a holding member 16 in the form of a bar clamp 16b is shown clampably engaged with respect to a floor joist 18'. A bar clamp of suitable construction is a QUICK-GRIP model 00506 bar clamp made by VISE-GRIP Tools, and covered under U.S. Pat. No. 4,926,722. A modification thereof is necessary in that a connection hole 50 is added at the handle thereof so as to connect the aforementioned hook or snap 52 with respective suspension members 14a, 14b. Still another holding member 16 in the form of a hook 16c that is structured to hook onto a suitable overhead structure 18, such as a water pipe 18'', is shown in FIG. 4. The hook 16c is respectively connected with each of the suspension members 14a, 14b. Of course, to those of ordinary skill in the art, other forms of holding member 16 may become apparent, the foregoing being presented only by way of preferred example.

To those skilled in the art to which this invention appertains, the above described preferred embodiment may be subject to change or modification. For example, utilization of first and second suspension members is by way of example only, wherein two spaced apart connections at each end of the tray per each suspension member is provided for safe and balanced suspension of the tray. However, one suspension member can be used, provided it has a plurality of symmetrically spaced apart connection locations with respect to the tray, or, alternatively, more than two suspension members can be used so as to provide a mutually symmetrically spaced connection with the tray. Such change or modification can be carried out without departing from the scope of the invention, which is intended to be limited only by the scope of the appended claims.

What is claimed is:

1. A suspendable tray for being selectively suspended from an overhead structure, comprising:

tray means for holding articles;

holding means for selectively connecting with the overhead structure; and suspension member means connected with said tray means and said holding means for providing an elongate and substantially flexible connection therebetween;

wherein said suspension member means connects with said tray means in a predetermined symmetrically spaced pattern so as to provide balanced suspension of said tray means with respect to said suspension member means when said holding means is connected with the overhead structure;

wherein a length is defined along said suspension member means between said tray means said holding member means, wherein further said suspension member means further comprises length adjustment means for selectively adjusting said length.

2. The suspendable tray of claim 1, wherein said holding means is selected from the group consisting of a hook, a spring clamp and a bar clamp.

3. The suspendable tray of claim 1, wherein said tray means comprises a floor and a sidewall connected with said floor, said tray means further comprising dividing wall means connected with said sidewall for providing at least one selectively removable dividing wall for separating articles within said tray means.

4. The suspendable tray of claim 1, wherein said tray means comprises a floor and a sidewall connected with said floor, said suspendable tray further comprising exterior pouch means connected with said sidewall for providing articles storage adjacent to said sidewall and exterior to said tray means.

5. The suspendable tray of claim 1, wherein said tray means comprises a floor and a sidewall connected with said floor, said tray means further comprising a lip connected with said sidewall, said lip being provided with a plurality of apertures for retaining articles therethrough.

6. The suspendable tray of claim 5, further comprising:

dividing wall means connected with said sidewall for providing at least one selectively removable dividing wall for separating articles within said tray means; and exterior pouch means connected with said sidewall for providing articles storage adjacent to said sidewall and exterior to said tray means;

wherein said holding means is selected from the group consisting of a hook, a spring clamp and a bar clamp.

7. A suspendable tray for being selectively suspended from an overhead structure, comprising:

tray means for holding articles, said tray means having a first end and an opposite second end;

an first suspension member having a first end and a second end, said first end of said first suspension member being connected with said tray means at substantially said first end thereof, said first suspension member being elongate and substantially flexible;

a second suspension member having a first end and a second end, said first end of said second suspension member being connected with said tray means at substantially said second end thereof, said second suspension member being elongate and substantially flexible; and holding means connected, respectively, to each second end of said first and second suspension members for selectively connecting said first and second suspension members to the overhead structure;

wherein a first length is defined between said first and second ends of said first suspension member and a second length is defined between said first and second ends of said second suspension member, wherein further and first and second suspension members further comprise length adjustment means for selectively adjusting, respectively, said first and second lengths.

8. The suspendable tray of claim 7, wherein said tray means comprises a tray having a floor and a sidewall connected to said floor, wherein further said first suspension member is connected with said tray at a first pair of mutually spaced apart locations, said second suspension member being connected with said tray at a second pair of mutually spaced locations, said first and second mutually spaced locations being symmetrically spaced so as to provide a balanced suspension of said tray with respect to said first and second suspension members.

9. The suspendable tray of claim 8, wherein said first and second suspension members respectively comprise first and second components constructed of strap, and wherein said length adjustment means comprises one-way sliding clasp means connected, respectively, to each of said first and second suspension members for providing selective adjustment of said first and second lengths by one of said first and second components respectively of said first and second suspension members being adjustably looped with respect to the one-way sliding clasp means that is connected, respectively, thereto.

10. The suspendable tray of claim 8, further comprising exterior pouch means connected with said sidewall for providing articles storage adjacent to said sidewall and exterior to said tray.

11. The suspendable tray of claim 8, wherein said holding means is selected from the group consisting of a hook, a spring clamp and a bar clamp.

12. The suspendable tray of claim 8, wherein said tray further comprises a lip connected with side sidewall, said lip being provided with a plurality of apertures for retaining articles therethrough.

13. The suspendable tray of claim 8, wherein said tray further comprises dividing wall means connected with said sidewall for providing at least one selectively removable dividing wall for separating articles within said tray.

14. The suspendable tray of claim 13, wherein said holding means is selected from the group consisting of a hook, a spring clamp and a bar clamp.

15. The suspendable tray of claim 14, further comprising exterior pouch means connected with said sidewall for providing articles storage adjacent to said sidewall and exterior to said tray.

16. The suspendable tray of claim 15, wherein said tray further comprises a lip connected with said sidewall, said lip being provided with a plurality of apertures for retaining articles therethrough.

17. The suspendable tray of claim 16, wherein said first and second suspension members respectively comprise first and second components constructed of strap, and wherein said length adjustment means comprises one-way sliding clasp means connected, respectively, to each of said first and second suspension members for providing selective adjustment of said first and second lengths by one of said first and second components respectively of said first and second suspension members being adjustably looped with respect to the one-way sliding clasp means that is connected, respectively, thereto.

18. A suspendable tray for being selectively suspended from an overhead structure, comprising:

tray means for holding articles;

holding means for selectively connecting with the overhead structure; and suspension member means connected with said tray means and said holding means for providing an elongate and substantially flexible connection therebetween;

wherein a length is defined along said suspension member means between said tray means said holding member means, wherein further said suspension member means further comprises length adjustment means for selectively adjusting said length.

* * * * *